US009494165B2

(12) United States Patent
Markwalder et al.

(10) Patent No.: US 9,494,165 B2
(45) Date of Patent: Nov. 15, 2016

(54) TURBO ENGINE WITH IMPROVED COMPENSATING PISTON GASKET

(75) Inventors: Alfred Markwalder, Wuerenlos (CH); George Kleynhans, Buelach (CH); Urs Baumann, Seuzach (CH)

(73) Assignee: MAN Diesel & Turbo SE, Augsburg (DE)

( * ) Notice: Subject to any disclaimer, the term of this patent is extended or adjusted under 35 U.S.C. 154(b) by 551 days.

(21) Appl. No.: 12/866,830

(22) PCT Filed: Nov. 3, 2008

(86) PCT No.: PCT/EP2008/009253
§ 371 (c)(1),
(2), (4) Date: Aug. 9, 2010

(87) PCT Pub. No.: WO2009/112064
PCT Pub. Date: Sep. 17, 2009

(65) Prior Publication Data

US 2010/0322765 A1 Dec. 23, 2010

(30) Foreign Application Priority Data

Mar. 10, 2008 (DE) ..... 10 2008 013 433

(51) Int. Cl.
*F04D 29/42* (2006.01)
*F04D 17/12* (2006.01)
*F04D 29/051* (2006.01)

(52) U.S. Cl.
CPC ..... *F04D 29/4206* (2013.01); *F04D 17/125* (2013.01); *F04D 29/0516* (2013.01)

(58) Field of Classification Search
USPC ..... 415/104, 171.1, 230
See application file for complete search history.

(56) References Cited

U.S. PATENT DOCUMENTS 2,161,695 A * 6/1939 Bigelow ..... F04D 1/063 415/108
2,221,225 A * 11/1940 Weis ..... F04D 29/041 277/361
2,365,310 A 12/1944 Thomann et al.
2,601,828 A * 7/1952 Lobanoff ..... F04D 1/063 415/100
3,370,542 A * 2/1968 Harney ..... 415/47
3,801,217 A * 4/1974 Ryall et al. ..... 415/199.2
3,827,770 A * 8/1974 Horler ..... 384/107
3,927,763 A * 12/1975 Strub et al. ..... 206/319
4,715,778 A * 12/1987 Katayama ..... F04D 29/051 415/104

(Continued)

FOREIGN PATENT DOCUMENTS

| | | |
|---|---|---|
| CN | 86 1 02901 | 7/1980 |
| CN | 86 1 02901 | 11/1986 |
| DE | 1 528 679 | 7/1969 |
| DE | 36 14 144 | 10/1987 |
| DE | 41 26 037 | 2/1993 |
| DE | 10144841 | 10/2002 |
| DE | 10 2008 051 384 | 2/2010 |
| JP | 60-098194 | 1/1985 |
| JP | 60 098194 | 6/1985 |
| JP | 06-031196 | 2/1994 |
| JP | 6-31196 | 8/1994 |

*Primary Examiner* — Craig Kim
*Assistant Examiner* — Brian O Peters
(74) *Attorney, Agent, or Firm* — Cozen O'Connor

(57) ABSTRACT

A flow machine (1) has an outer housing (2) with an inner housing (6), particularly a guide blade carrier, arranged therein and a rotor shaft (10) which is situated in the latter, a cover (4; 8) which is fastened to the outer housing (2) and separates an inlet pressure (p1) in the interior of the outer housing (2) from an ambient pressure (pu) outside the outer housing, and a compensating piston seal (22) for sealing an outlet pressure (p2) in a work space, particularly compression space (16), defined between the rotor shaft (10) and the inner housing (6) against the inlet pressure (p1) in a non-contacting manner. The compensating piston seal (22) is fastened to the cover (4; 8).

17 Claims, 5 Drawing Sheets

(56) References Cited

U.S. PATENT DOCUMENTS 5,161,943 A * 11/1992 Maier et al. ..... 415/170.1
5,344,515 A * 9/1994 Chenock, Jr. ..... 156/171
5,718,560 A * 2/1998 Lorenzen ..... 415/47
6,884,031 B2 * 4/2005 Gregory ..... 415/199.2
2009/0160135 A1 * 6/2009 Turini et al. ..... 277/418

* cited by examiner

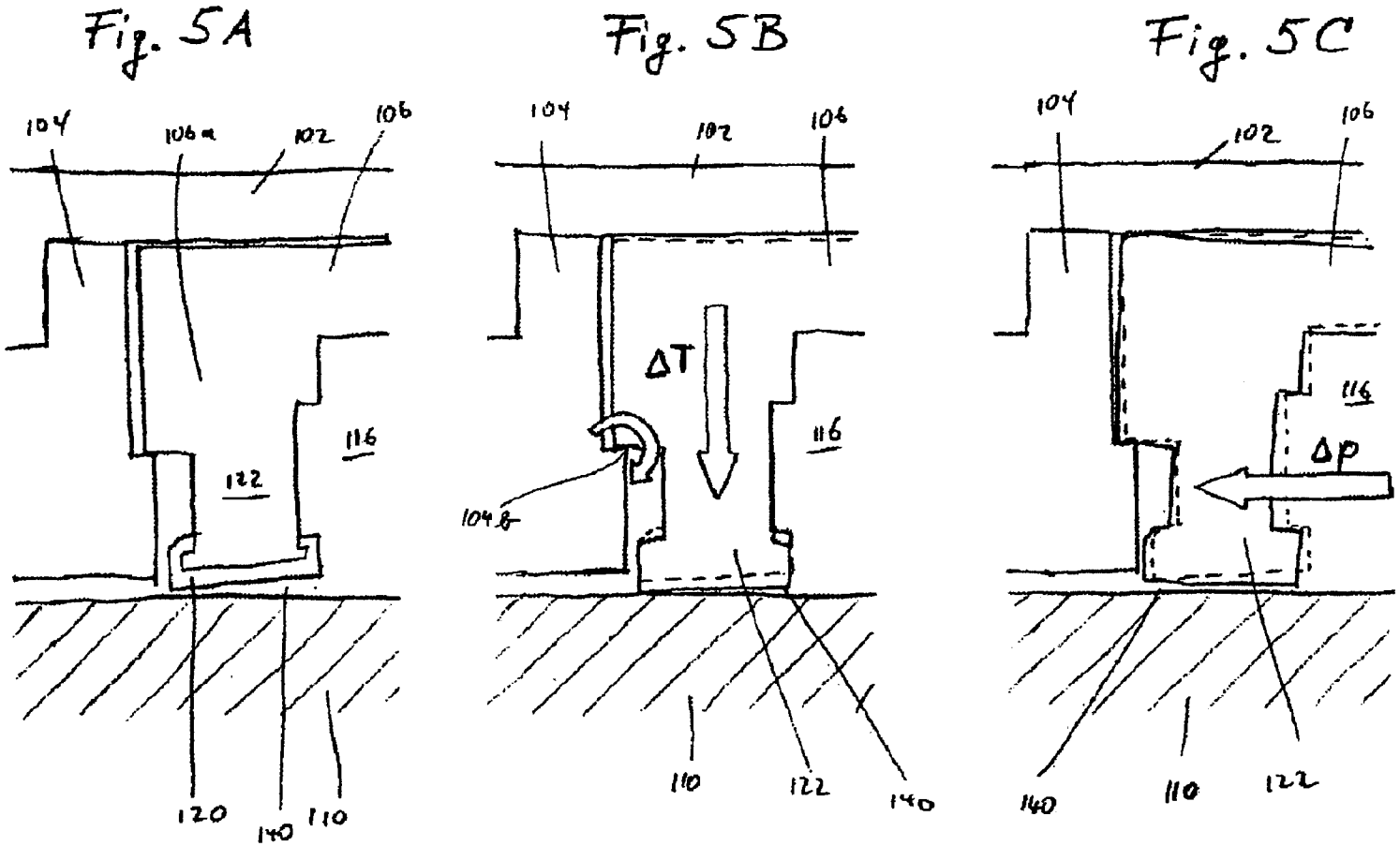
PRIOR ART

TURBO ENGINE WITH IMPROVED COMPENSATING PISTON GASKET

PRIORITY CLAIM

This is a U.S. national stage of application No. PCT/EP2008/009253, filed on Nov. 3, 2008. Priority is claimed on the following application: Country: Germany, Application No.: 10 2008 013 433.3, Filed: Mar. 10, 2008, the content of which is/are incorporated here by reference.

FIELD OF THE INVENTION

The present invention is directed to flow machines such a turbo engine or a compressor with an improved compensating piston seal.

BACKGROUND OF THE INVENTION

In high-pressure compressors in particular, sealing against the environment is achieved by means of a shaft seal which is generally formed as a dry gas seal. This seals an inlet pressure against the environment on both axial sides of the compressor. In addition, a compensating piston seal which seals the outlet pressure against the inlet pressure on the pressure side of the compressor is provided to reduce the thrust of the engine and to ensure the inlet pressure on both sides of the shaft in front of the dry gas seal.

Generally, these seals have a hollow stator which embraces the rotor, and the rotor, stator, or both, have recesses on the surfaces. In operation, i.e., when the shaft is rotating, a dynamic resistance is formed between the opposite surfaces of the rotor and stator which opposes a movement of the fluid in axial direction through the sealing gap.

The design of this compensating piston seal is very important for the functionality of the flow machine because the greater pressure difference is generally sealed by this seal and, therefore, the greater dynamic forces occur between the rotor and stator. These dynamic forces influence the stability of the running behavior among other things. When this seal is correctly designed, the rotordynamic stability of turbo compressors can be substantially improved, for example.

Hole pattern (HP) seals in particular are known as a special constructional form of compensating piston seals in which the recesses provided on the inner surface of the stator have the shape of substantially circular holes. In addition, honeycomb (HC) seals are also known in which the recesses provided on the inner surface of the stator are honeycomb-shaped, i.e., have a netlike shaped hexagonal holes. A gap is formed between the inner surface of the stator and the outer surface of the rotor so that there is no contact between the two sealing surfaces.

To ensure the positive effect of the hole pattern design, it is crucially important to be aware of and monitor the geometry of the sealing gap during operation. Formerly, in conventional constructions this was difficult and sometimes impossible. Therefore, compressors with hole pattern seals were often unsuccessful in the past due to rotordynamic instability. The complex of problems will be illustrated in the following example.

FIG. 3 shows a known, in-house compressor 100. An autoclave cover 104, as it is called, is inserted into an outer housing 102, an inner housing 106 being supported at this autoclave cover 104. The housing is closed by a closing cover 108. A shaft 110 is supported by shaft bearings 112 and 112' in bearing housings 114 and 114', respectively, which are in turn fastened to the autoclave cover 104 and closing cover 108. The compressor stages with their installed components (not shown in more detail) are located in a work space 116 which is defined by the autoclave cover 104, the inner housing 106, the closing cover 108 and the shaft 110.

Shaft seals 124, 124' which seal an inlet pressure of the compressor against the ambient pressure are arranged on both sides of the work space. The inlet pressure prevails at the inner compressor side of these two seals so that the shaft seals 124, 124' are pressed apart by the pressure difference between the inlet pressure and the ambient pressure. Seal spaces at the inner compressor sides of the two shaft seals 124, 124' communicate with one another via an equalization line (not shown).

In addition, a compensating piston seal 122 is provided on the outlet side (at left in FIG. 3) between the seal space and the actual work space. This compensating piston seal 122 is formed substantially of an end portion 106*a* of the inner housing 106 and a seal bushing 120 inserted therein and seals the outlet pressure against the inlet pressure.

FIG. 4 shows the area of this compensating piston seal 122 in detail. FIG. 4 is an enlarged view of a detail which is indicated in FIG. 3 by a circle "IV" in dash-dot lines. As is shown in FIG. 4, the work space 116 with its installed parts on the outlet pressure side is defined by the radial and axial inner surfaces of the inner housing 106 and outer surface of the shaft 110. A radially inwardly projecting end portion 106*a* of the inner housing 106 annularly encloses a sealing portion 110*a* of the shaft 110 and forms the boundary of the work space 116 in axial direction. A seal element 120 is arranged at the inner surface of the end portion 106*a*. This seal element 120, which contains the above-described recesses (not shown), reduces the gap between this inner surface of the end portion 106*a* of the housing and the outer surface of the sealing portion 110*a* of the shaft to a predetermined extent and defines the geometry of the gap.

The inner housing is formed of two parts, an upper half and a lower half, to allow the rotor to be inserted. The seal element 120 which is formed as a seal bushing is likewise split in radial direction into an upper half and a lower half. These two half-rings are screwed into the corresponding grooves of the inner housing.

However, the seal arrangement described above has some disadvantages. A substantial difficulty with respect to dimensioning and operation is illustrated in FIGS. 5A to 5C. FIGS. 5A to 5C substantially correspond to the section in FIG. 4, but are substantially more schematic. Only portions of the housing 102, autoclave cover 104, inner housing 106, including its end portion 106*a* which, together with the seal element 120, forms the compensating piston seal 122, and portions of the shaft 110 and work space 116 are shown. A sealing gap between the seal element 120 and the shaft 110 is designated by 140. FIG. 5A shows the geometry, as produced, which represents the design state. FIG. 5B shows the influence of a large, mostly transient, temperature difference between the outer housing and the inner housing on the geometry of the seal arrangement, this temperature difference being based in part on the fact that the inner housing becomes hot substantially faster than the outer housing when the engine is started, and FIG. 5C shows the influence of a large pressure difference along the compensating piston seal 122. FIGS. 5B and 5C show the finished, unloaded geometry from FIG. 5A in dashed lines.

As is shown in FIG. 5A, the sealing gap 140 in hole pattern seals and honeycomb seals in the design state becomes narrower outward, i.e., converges in the assumed flow-out direction or leakage direction. Under the influence of a large temperature difference, the inner housing 106 expands, the end portion 106*a* expands toward the inside, and the sealing gap 140 becomes narrower (see FIG. 5B). Further, the expansion of the end portion 106*a* is blocked by a shoulder 104*b* of the autoclave cover 104 so that the entire end portion 106*a* rotates around this shoulder 104*b*. Therefore, the sealing gap 104 not only becomes narrower but is also divergent in addition. Under the influence of a large pressure difference between the outlet pressure and the inlet pressure along the seal, the end portion 106*a* bulges outward, which also results in the sealing gap 140 becoming more divergent. As a result, the gap geometry is very difficult to control. In extreme cases, this leads to a divergent gap which results in unstable rotordynamics. The change in geometry of the sealing gap 140 can even take on the order of magnitude of the gap height.

The object of the present invention is to improve the compensating piston seal in a flow machine.

SUMMARY OF THE INVENTION

A flow machine according to the present invention has an outer housing with an inner housing arranged therein and a rotor shaft which is situated in the latter, at least one cover which is fastened to, particularly inserted in, the outer housing and divides an inlet pressure in the interior of the outer housing from an ambient pressure outside the outer housing, particularly by means of a shaft seal, and a compensating piston seal for sealing the outlet pressure from the inlet pressure which is arranged at the cover. The flow machine can be, for example, a compressor, particularly a high-pressure compressor. When the flow machine is a compressor, the work space is a compression chamber.

The cover of a flow machine which can be, for example, an autoclave cover or a closing cover, is generally substantially more rigid than the inner housing whose end portion is often formed of a comparatively thin shell. Therefore, a cover of this kind has a greater shape stability and dimensional stability than the inner housing. If the compensating piston seal is fastened to this cover instead of the inner housing, according to the invention, deformations of the inner housing can no longer affect the position of the seal. In this way, the geometric ratios and, therefore, the characteristics of the seal can be controlled more easily. The flow machine advantageously has at least one inner seal and at least one outer seal.

The work space of the flow machine can be defined at one axial end substantially by an inner wall of the cover. In this way, a greater design freedom can be achieved with respect to the cover and the flow guiding elements in the work space. The cover is also a substantially more rigid component element than the inner housing and is less deformed under large pressure differences and temperature differences. In this way, the geometry of the work space can also be better defined and the flow conditions in the work space can be better controllable.

A first shaft seal which seals an inlet pressure from an ambient pressure can be arranged on the side of the flow machine, particularly the cover, opposite the work space. A seal space between this first shaft seal and the compensating piston seal can communicate with a seal space which is formed on the inner compressor side of a second shaft seal which seals the work space on the side opposite the first shaft seal from the surroundings.

The compensating piston seal can have a substantially hollow-cylindrical fit sleeve or piston bushing which is fastened, preferably by positive engagement and/or frictional engagement, inside at least one portion of a through-hole of the cover penetrated by the rotor shaft and encloses the rotor shaft without contacting it. The seal can be changed comparatively easily without modifying the supporting components by inserting a sleeve or bushing. It can also be simpler to perform high-precision shaping, machining or surface treatment processes on a comparatively manageable component part.

The sleeve or bushing can have a first annular portion which projects radially outward at the axial end facing the work space and which contacts a wall of the cover, particularly of a projecting fastening portion, facing the work space. With an arrangement of this kind, the sleeve or busing can easily be inserted into the cover from the work space side and, additionally, be fixed in its axial position when pressure is applied from the work space side.

The sleeve or bushing can have a second annular portion which projects out in axial direction from a radially outer edge of the first annular portion and is received in a correspondingly formed recess in the wall of the cover, particularly of a projecting fastening portion. A simple and precise centering and fixating of the radial position of the seal can be achieved in this way.

An annular gap with a predetermined geometry is preferably formed between the rotor shaft and the compensating piston seal. This makes it possible in an advantageous and simple manner to realize a noncontacting shaft seal and adapt it to the pressure, temperature and flow conditions occurring during operation. Due to the convergent and/or divergent shaping of the gap in at least one portion thereof, defined pressure curves can be achieved in the gap and the seal characteristics can accordingly be adjusted and optimized.

The compensating piston seal can have recesses in at least one portion of its surface facing the rotor shaft. The recesses can be, for example, substantially circular or polygonal, particularly hexagonal, in cross section. When the shaft is running, the recesses generate a flow resistance which can benefit sealing of the work space and improve the stability characteristics of the rotor.

In order to adapt to the circumstances of different types of flow machines, the compensating piston seal can be designed to seal against a high pressure in the work space of greater than 50 bar, in particular greater than 100 bar, preferably greater than 500 bar.

BRIEF DESCRIPTION OF THE DRAWINGS

Further advantages and features of the invention are described in the following with reference to the accompanying drawings in which:

FIGS. 5A-5C shows the seal arrangement from FIG. 4 in different operating states.

DETAILED DESCRIPTION OF THE PRESENTLY PREFERRED EMBODIMENTS

Figure 1:
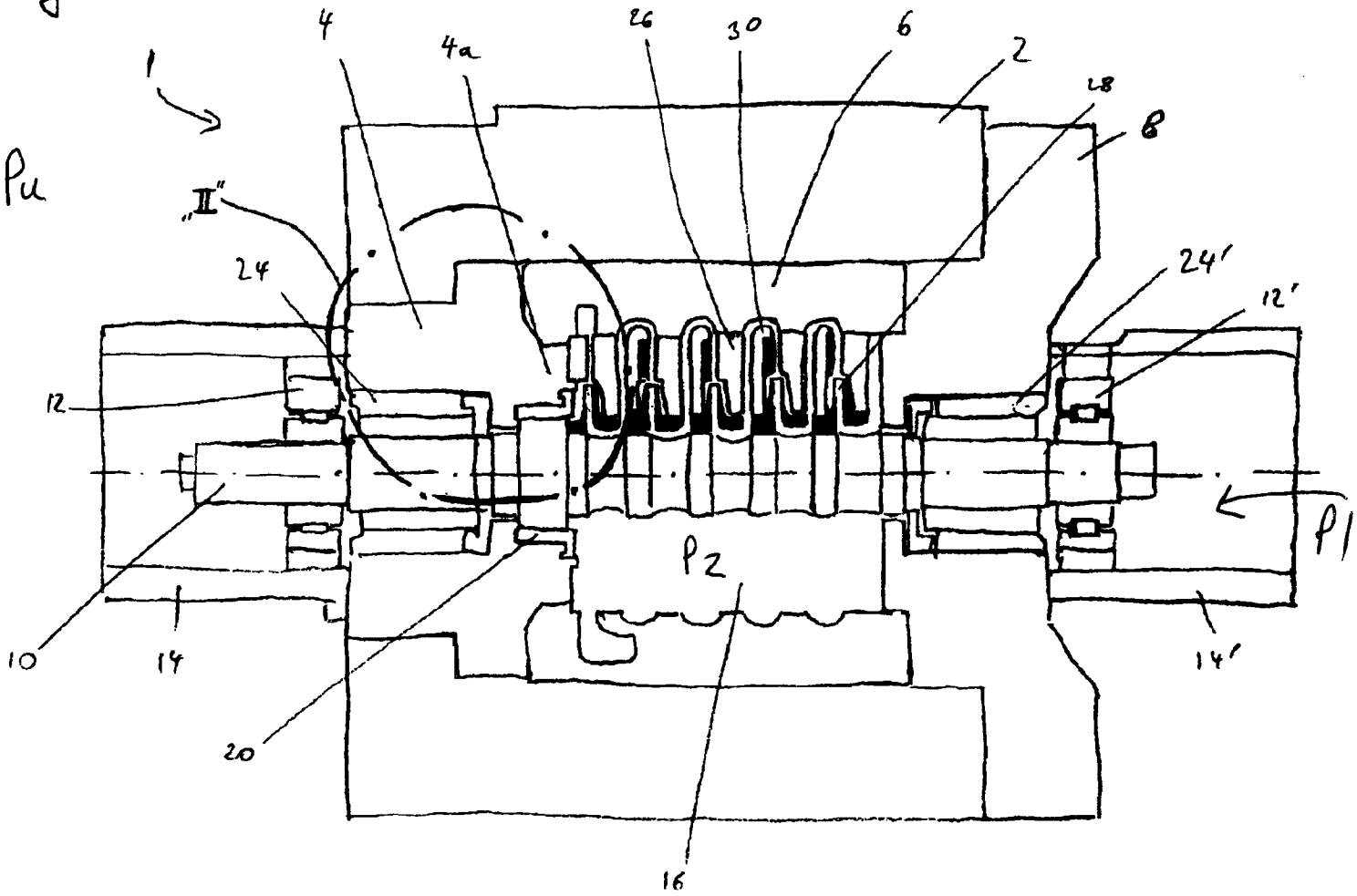
FIG. 1 is a general view of a flow machine according to an embodiment of the present invention in longitudinal section.
Figure 2:
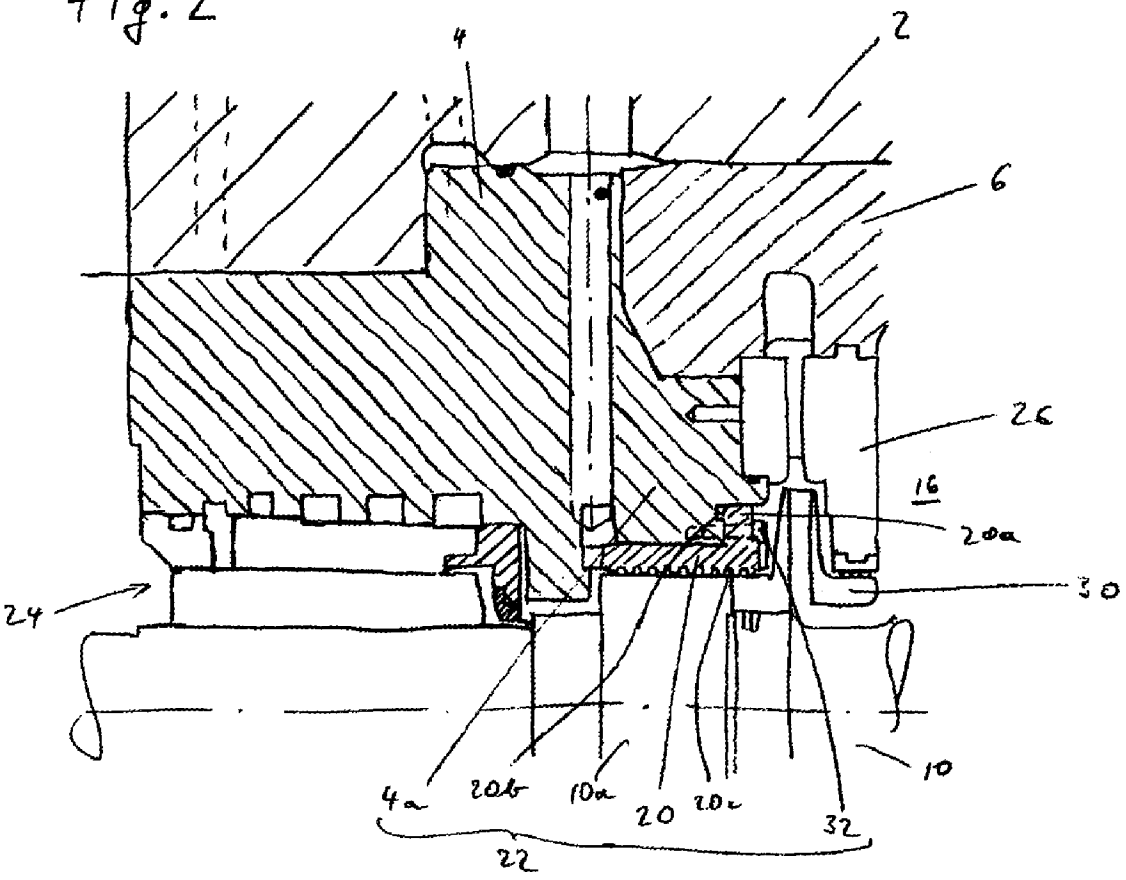
FIG. 2 is a detailed view of a detail indicated in FIG. 1 by a dash-dot circle designated by "II"
Figure 3:
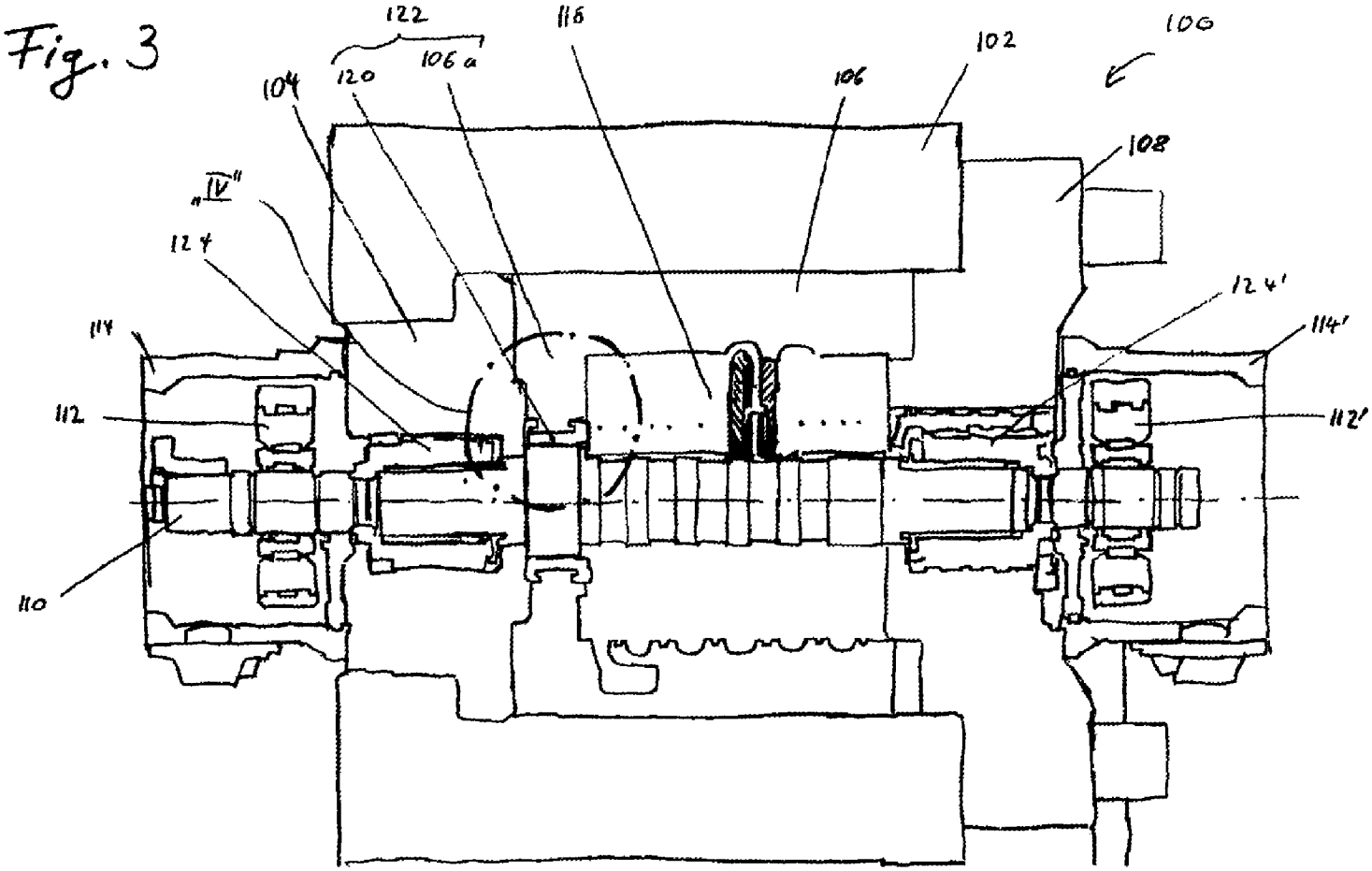
Fig. 3 PRIOR ART
FIG. 3 is a general view of a flow machine according to the prior art in longitudinal section.
Figure 4:
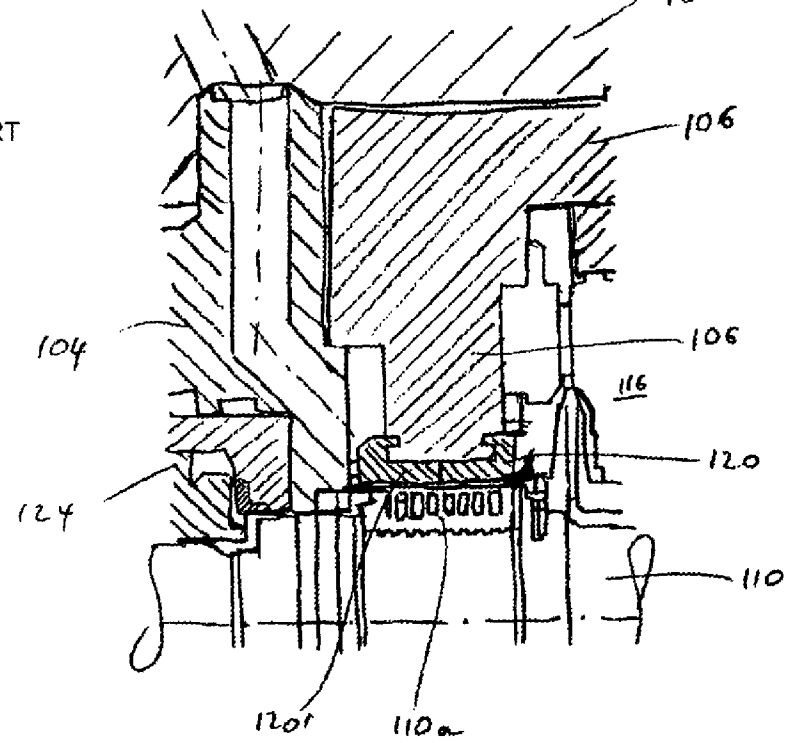
Fig. 4 PRIOR ART
FIG. 4 is a detailed view of a detail indicated in FIG. 3 by a dash-dot circle designated by "IV"

An embodiment of the present invention is shown in FIGS. 1 and 2. FIG. 1 shows a high-pressure compressor 1 as an example of a flow machine.

An autoclave cover 4 representing a cover within the meaning of claim 1 is inserted in an outer housing 2, an inner housing 6 being supported at this autoclave cover 4. The outer housing 2 is closed on the side opposite the autoclave cover 4 by a closing cover 8 which can also represent a cover within the meaning of claim 1 in another construction, not shown. A rotor shaft 10 is supported by shaft bearings 12 and 12' in bearing housings 14 and 14', respectively, which are in turn fastened to the autoclave cover 4 and closing cover 8, respectively.

The compressor stages along with their installed parts 26, 28, 30 are located in a work space 16 which is defined by the autoclave cover 4, the inner housing 6, the closing cover 8 and the shaft 10. The inner housing 6 carries the installed parts 26 of the compressor stages, the shaft 10 supports the rotors 28 of the compressor stages. Shaft seals 24, 24' in the autoclave cover and closing cover 4, 8, respectively, seal the interior of the compressor against the environment.

Ambient pressure pu prevails outside the outer housing 2, the outlet pressure p2 prevails in the work space 16 on the inlet side or pressure side (at left in FIG. 1), and the inlet pressure p1 prevails on the inlet side or suction side (at right in FIG. 1) so that the right-hand shaft seal 24' in FIG. 1 in the closing cover 8 is acted upon by the pressure difference between the inlet pressure and ambient pressure.

In addition, according to the invention, a compensating piston seal 20 is arranged between the left-hand shaft seal 24 in FIG. 1 in the autoclave cover 4 and the work space 16 on the outlet side. This compensating piston seal 20 seals the outlet pressure p2 on the outlet side of the work space 16 against a seal space which is formed between the shaft seal 24 and the compensating piston seal 20 and in which the inlet pressure p1 also prevails. For this purpose, this seal space communicates with a corresponding seal space on the inlet side or suction side of the compressor between the work space 16 and the shaft seal 24' in the closing cover 8.

In this way, the left-hand shaft seal 24 in the autoclave cover 4 in FIG. 1 is also only acted upon by the pressure difference between the inlet pressure and ambient pressure, while the compensating piston seal 20 seals the outlet pressure against the inlet pressure. In this way, the thrust of the engine is reduced.

As is shown in FIG. 2, the work space 16 with its installed parts is defined on the pressure side by the inner surfaces of the inner housing 6 and autoclave cover 4 and the outer surface of the shaft 10.

The autoclave cover 4 has a projection 4*a* which projects in direction of the work space 16 and accordingly defines the work space 16 in axial direction on the side of higher pressure and which annularly encloses a sealing portion 10*a* of the shaft 10. A bearing bushing 20, which is a hollow cylindrical sleeve, is arranged on the inner surface of the projection 4*a* and reduces the gap between this inner surface of the projection 4*a* and the outer surface of the sealing portion 10*a* with defined geometry to a predetermined extent. The projection 4*a* at which the bearing bushing 20 is arranged and fastened is accordingly a fastening portion within the meaning of the present invention.

The bearing bushing 20 has a first annular portion 20*a* which projects radially outward from its axial end located on the side of the work space 16 and contacts the side of the projection 4*a* facing the work space 16. The portion 20*a* is fastened to the side of the projection 4*a* facing the work space 16 by means of screws 32. Further, the portion 20*a* has a second annular portion 20*b* which extends axially from the first portion 20*a* in direction of the autoclave cover 4 and engages in a corresponding counter-groove in the surface of the projection 4*a*.

Further, the bearing bushing 20 has circular recesses 20*c* on its inner surface. These recesses ensure, in a manner known per se, that a fluid-dynamic blocking effect occurs during operation of the engine and seals the outlet pressure against the inlet pressure.

Although it is not shown in more detail in the drawings, it is possible depending upon requirements to form the recesses 20*c* in different ways. The recesses 20*c* are preferably formed as circular recesses which penetrate substantially perpendicularly (i.e., in radial direction) into the inner surface of the bushing 20 to a predetermined depth. However, the recesses 20*c* can also be inclined in circumferential direction in, or opposite to, the direction of revolution of the shaft 10 in order to generate turbulence to the desired extent. The cross section of the recesses 20*c* can decrease in the depth direction. The circular recesses 20*c* are known, per se, to the person skilled in the art as a hole pattern seal.

As was described above, in contrast to the prior art described above, the bearing bushing 20 is fastened to the comparatively rigid autoclave cover 4 rather than to the inner housing 6. A substantially stiffer design is achieved in this way and the otherwise large deformations of the inner housing 6 are prevented from influencing the bearing bushing 20. The rigidity in this portion can be further increased in that the fastening portion for the bearing bushing 20 is formed as a projection 4*a*. The deformations of the seal arrangement are accordingly smaller by orders of magnitude and the gap geometry is also maintained to a great extent under the influence of temperature differences and pressure differences. Therefore, dimensioning of the seal arrangement is simplified and is easier to control. Further, in a preferred construction it is possible to manufacture the bushing 20 in one piece which further improves the shape stability of the sealing gap.

Although the embodiments described above essentially relate to hole pattern seals, the present invention can also be applied to other types of annular gap seals in which exact knowledge of the geometry of the annular gap is important, e.g., honeycomb seals, groove seals, labyrinth seals, or the like. In the honeycomb seal, recesses having a substantially hexagonal cross section which are separated from one another by a netlike structure are formed in the inner surface of the bearing bushing.

The invention has been described above with reference to a high-pressure compressor 1 in which the compensating piston seal 20 was arranged at its autoclave cover 4. Of course, as has already been stated, the sides of the flow machine or closing cover and autoclave cover can also be exchanged.

The invention is not limited by the embodiments described above which are presented as examples only but can be modified in various ways within the scope of protection defined by the appended patent claims.

The invention claimed is:

1. A flow machine (1) comprising:

an outer housing (2) and an inner housing (6) disposed radially inwardly of said outer housing (2), a rotor shaft (10) and installed parts (26) of compressor stages of said flow machine (1) being disposed within said inner housing (6);

an autoclave cover (4) fastened to and disposed entirely radially inwardly of said outer housing (2), said autoclave cover directly contacting a longitudinal end of said inner housing (6) and radially supports the longitudinal end and configured to separate an inlet pressure (p1) in the interior of said outer housing (2) from an ambient pressure (pu) outside said outer housing, the autoclave cover (4) being more rigid than said inner housing;

a closing cover (8) configured to close the outer housing (2) on a side of the flow machine (1) opposite the autoclave cover (4), the autoclave cover (4), the inner housing (6), the closing cover (8) and the rotor shaft (10) defining a work space (16);

a compensating piston seal (22) configured to seal an outlet pressure (p2) in the work space (16) against the inlet pressure (p1) in a noncontacting manner, said compensating piston seal (22) being fastened to said autoclave cover (4); and a shaft seal in the autoclave cover, the shaft seal and the compensating piston seal (22) cooperating such that the shaft seal is only acted upon by the pressure difference between the inlet pressure (p1) and the ambient pressure (pu) while the compensating piston seal (22) seals the outlet pressure (p2) against the inlet pressure (p1), wherein a seal space is formed between the shaft seal and the compensating piston seal (22), in which seal space the inlet pressure (p1) prevails.

2. The flow machine (1) according to claim 1, wherein said autoclave cover (4) comprises a fastening portion (4*a*) projecting axially in the direction of said work space (16) for fastening said compensating piston seal (22).

3. The flow machine (1) according to claim 1, wherein said rotor shaft comprises an outer circumferential surface and said compensating piston seal comprises a surface facing said rotor shaft, one selected from the group consisting of said circumferential surface and said surface having a plurality of recesses therein, said recesses being one selected from the group consisting of substantially circular and substantially polygonal in cross section.

4. The flow machine (1) according to claim 1, wherein said compensating piston seal (22) is constructed to seal against a high pressure in the work space of greater than 50 bar.

5. The flow machine (1) according to claim 1 being one selected from the group consisting of a compressor and a high-pressure compressor.

6. The flow machine (1) according to claim 1, wherein said work space is a compression space.

7. The flow machine (1) according to claim 1, wherein said compensating piston seal (22) is constructed to seal against a high pressure in the work space of greater than 100 bar.

8. The flow machine (1) according to claim 1, wherein said compensating piston seal (22) is constructed to seal against a high pressure in the work space of greater than 500 bar.

9. The flow machine (1) according to claim 1, wherein an annular gap having a predetermined geometry is formed between said rotor shaft (10) and said compensating piston seal (22).

10. The flow machine (1) according to claim 9, wherein said annular gap formed between the rotor shaft (10) and the compensating piston seal (22) is convergent in at least one portion.

11. The flow machine (1) according to claim 9, wherein said annular gap formed between said rotor shaft (10) and said compensating piston seal (22) is divergent in at least one portion.

12. The flow machine (1) according to claim 1, wherein said autoclave cover (4) comprises a through hole penetrated by said rotor shaft (10) and wherein said compensating piston seal (22) comprises a substantially hollow-cylindrical sleeve (20) which is fastened so as to extend inside at least a portion of said through-hole and enclosing said rotor shaft without contacting the same.

13. The flow machine (1) according to claim 12, wherein said cylindrical sleeve (20) is fastened to said autoclave cover by one selected from the group consisting of positive engagement and frictional engagement.

14. The flow machine (1) according to claim 12, wherein said autoclave cover (4) comprises a wall facing said work space; and said sleeve (20) comprising a first annular portion (20*a*) projecting radially outward at the axial end of the compensating piston seal (22) facing said work space (16) and contacting said wall of said autoclave cover (4) facing said work space.

15. The flow machine (1) according to claim 14, wherein said first annular portion (20*a*) comprises an outer edge; and wherein said sleeve (20) comprises a second annular portion (20*b*) extending axially in direction of said autoclave cover (4) from said radially outer edge of said first annular portion (20*a*); said wall of said autoclave cover comprising a recess having a shape corresponding to said second annular portion (20*b*); said outer edge being received in said correspondingly formed recess in said wall of said autoclave cover (4).

16. The flow machine (1) according to claim 12, wherein said sleeve (20) is fastened to said autoclave cover by at least one connection element (32).

17. The flow machine (1) according to claim 16, wherein said connection element is one selected from the group consisting of a pin and a screw.

* * * * *